United States Patent [19]

Swerbinsky

[11] 4,142,766

[45] Mar. 6, 1979

[54] IMPACT REINFORCEMENT AND REPAIR METHOD FOR REFRIGERATOR CABINET LINERS

[75] Inventor: Leo Swerbinsky, Louisville, Ky.

[73] Assignee: General Electric Company, Louisville, Ky.

[21] Appl. No.: 867,080

[22] Filed: Jan. 5, 1978

[51] Int. Cl.[2] ..... F25D 11/00; B32B 3/00

[52] U.S. Cl. ..... 312/214; 312/236; 220/430; 248/345.1

[58] Field of Search ..... 312/214, 204, 236, 320; 220/430; 62/285; 248/345.1

[56] References Cited

U.S. PATENT DOCUMENTS

| | | | |
|---|---|---|---|
| 2,008,063 | 7/1935 | Cruikshank | 220/430 |
| 2,171,036 | 8/1939 | Money | 52/716 |
| 2,214,187 | 9/1940 | Swedman | 220/430 |
| 3,405,986 | 10/1968 | Cannon | 312/214 |
| 3,633,783 | 1/1972 | Aue | 312/214 |
| 3,634,925 | 1/1972 | Van Loo | 248/345.1 |
| 3,674,359 | 7/1972 | Crowe | 312/214 |
| 3,725,188 | 4/1973 | Kalt | 248/345.1 |
| 3,804,481 | 4/1974 | Tillman | 312/214 |
| 4,072,231 | 2/1978 | Helms | 248/345.1 |

*Primary Examiner*—Victor N. Sakran
*Attorney, Agent, or Firm*—Frederick P. Weidner; Francis H. Boos

[57] ABSTRACT

A reinforcement for increasing the resistance of the bottom front portion of refrigerator cabinet liners subject to impact damage, including a reinforcing strip secured to the vulnerable liner surface area by means of an adhesive foam strip, securing the strip to the liner surface and acting as a shock-absorbing cushion. The reinforcement is added either to undamaged liners to increase resistance to impact damage or as a field repair method to repair liners which have been damaged.

10 Claims, 4 Drawing Figures

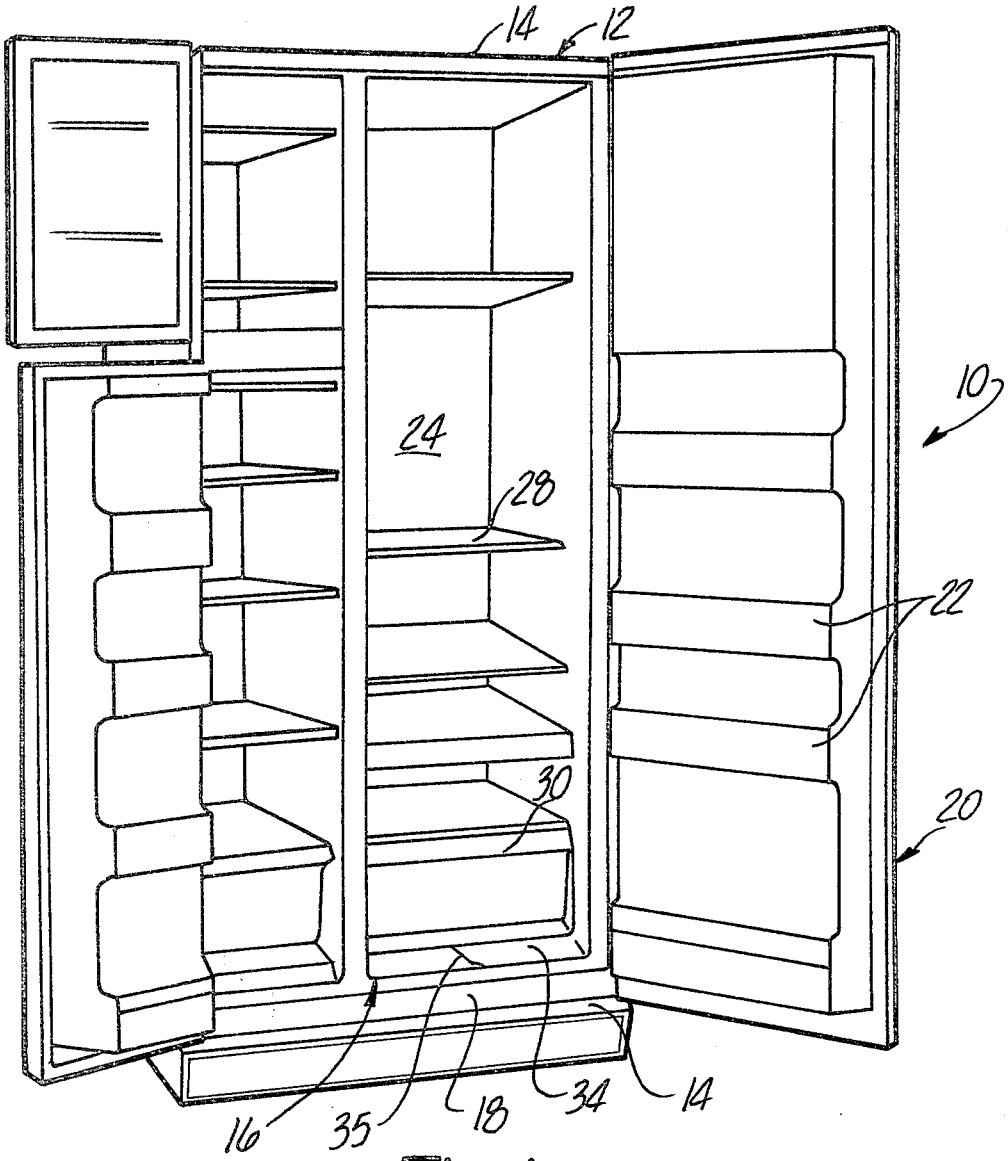
Fig-1
Fig-2
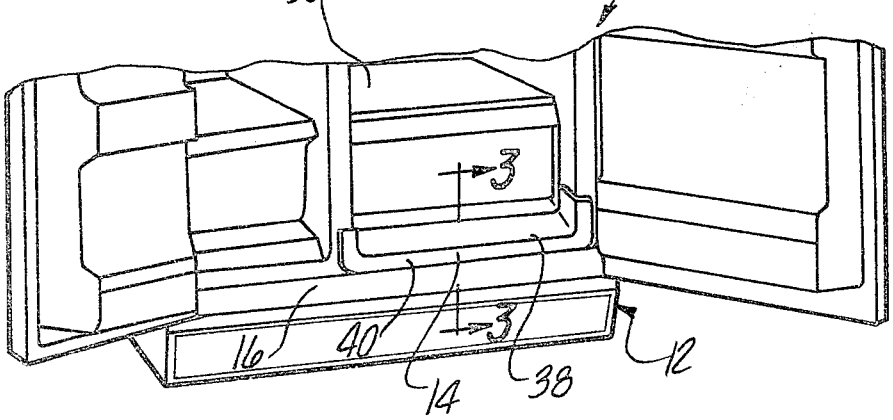

IMPACT REINFORCEMENT AND REPAIR METHOD FOR REFRIGERATOR CABINET LINERS

BACKGROUND DISCUSSION

This invention concerns refrigerator cabinet constructions and more particularly a reinforcement for impact damage vulnerable areas of the cabinet.

Refrigerator cabinet designs often include the assembly of an outer steel case to a cabinet liner which mates with the steel outer case to define the refrigerator cabinet. The liner construction provides for a sanitary lining of the interior food storage areas.

If steel liners were used directly joined to the outer case, the impact damage problem would be eliminated due to the much greater strength of steel. However, a thermal break must be provided to prevent undue chilling of the cabinet outer case in the region where it is joined to the inner liner, hence the need for plastic breaker strips.

Alternatively, one-piece plastic liners are utilized, formed of a thin, vacuum-formed ABS or similar plastic, directly joined to the steel outer case.

One-piece liners may be formed at relatively low cost by the aforementioned vacuum forming and simplifies the assembly of the refrigerator cabinet over the use of separate breaker strips.

Despite these advantages, there is a disadvantage to the one-piece liner design in that if the liner is damaged, repair or replacement of the liner involves major disassembly or tedious and time-consuming procedures and/or less than satisfactory results. This damage typically occurs in the bottom front area of the liner, forward of the food storage drawers or shelves since this area is subject to impact by dropped items. Repair of such damage has typically included the use of epoxy resins, but such repair procedures are time-consuming since the repairman must wait while the materials cure, which contributes to the cost of such repairs. In addition, the result may not be aesthetically acceptable and hence this approach has not afforded an entirely satisfactory solution.

The only alternative would be replacement of the entire liner which would be even less satisfactory in terms of the parts cost and repair time involved.

There has thus heretofore been proposed and implemented reinforcement arrangements to decrease the vulnerability of this area of the liner to impact damage. Typically, this surface is sloped downwardly such that dropped objects will strike a glancing blow. However, the available space for sloping of the surface is limited and only slight inclinations may be formed into the liner such that impact damage still may easily occur.

Another approach is disclosed in U.S. Pat. No. 3,804,481 in which the region in question is underlain by an adhesive, shock absorbing layer. While increasing the resistance to breakage, this requires redesign of the liner and creates an undesirable shoulder which makes the liner more difficult to wipe clean. It furthermore does not offer any solution to field repair of damaged liners.

Another approach in increasing the impact damage resistance to liners is to increase the thickness of the material in this region. However, the usual method for forming such liners, i.e., vacuum forming, limits the degree of increased thickness of materials which can be formed and the increased strength so obtainable is not sufficient to preclude continuing incidence of impact damage.

It is accordingly an object of the present invention to provide an impact reinforcement for refrigerator cabinet liners which does not necessarily require redesign of the refrigerator liner in order to be added to the refrigerator cabinet structure.

It is yet another object of the present invention to provide such an impact reinforcement which may also be utilized to repair liners which have become damaged in the field.

It is still another object of the present invention to provide such an impact reinforcement and repair method which is easily carried out and which provides superior protection for the vulnerable impact zone of refrigerator cabinet liners.

SUMMARY OF THE INVENTION

These and other objects of the present invention, which will become apparent upon a reading of the following specification and claims, are accomplished by a reinforcement comprised of a strip formed of molded plastic material which is shaped to be received over the vulnerable area of the cabinet liner and extends up a short distance over the sides of the cabinet liner adjacent the bottom front area.

The reinforcing strip is secured in position by means of an adhesive layer which is preferably formed of a foamed material such as to act as a shock absorbing cushion in addition to providing ready securement of a reinforcing strip in position.

The reinforcing strip may be configured to be accepted over existing liner designs or the liner design alternatively may be modified to be offset to receive the reinforcing strip to provide a smoother contour with the reinforcing strip in place.

DESCRIPTION OF THE DRAWINGS

FIG. 1 is a perspective view of a refrigerator cabinet, illustrating the vulnerable bottom front portion of the cabinet liner.

FIG. 2 is a perspective view of a portion of the cabinet depicting the reinforcing strip applied to the liner.

DETAILED DESCRIPTION

Figure 3:
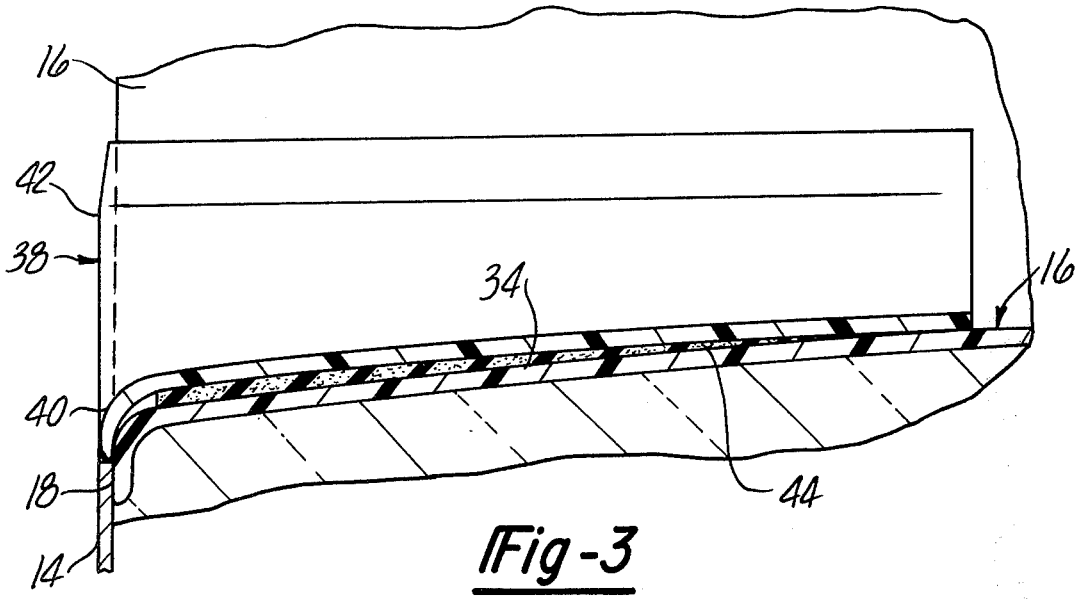
FIG. 3 is a view of the section 3—3 taken in FIG. 2 through the cabinet liner and reinforcing strip.

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIG. 1, modern refrigerators 10 typically include a refrigerator cabinet 12 having a steel outer case 14, which is mounted to a one-piece plastic liner 16. The plastic liner 16 has a flange 18 which mates with a reentry flange on the steel outer case 14. The refrigerator door 20 is provided with food carrying shelves 22 which are provided to efficiently utilize the interior space 24 of the refrigerator cabinet 12. The door 20 accordingly has substantial depth which must be accommodated by the refrigerator interior space 24. Thus, the food carrying shelves 28 and drawers 30 are recessed from the frontal face 32 to accommodate the depth required by the food carrying shelves 22. This recessing creates a region 34 of the liner 16 which becomes exposed upon opening of the door 20. The bottom front region 34 of the exposed surface of the liner 16 becomes susceptible to impact by items being handled in moving, being placed in the refrigerator or being removed. Some of these items, such as large jars and bottles, are capable of causing impact damage 35 of the region 34 if they are dropped.

As noted, the one-piece construction of the liner 16 while affording design advantages as noted, leads to difficulties in satisfactory repair of the liner 16 and limitations in manufacturing processes limit the strengthening of this portion of the liner 16 such that impact damage will still occur. While the outermost region of the bottom front liner surface 34 is inclined slightly, this slope is relatively shallow and not adequate to completely eliminate the incidence of such impact damage.

According to the concept of the present invention, a reinforcing strip 38 (FIG. 2) is provided secured to the lower front surface 34 of the liner in the region which is created by the recessing of the shelves 28 and drawers 30, and which extends across the bottom surface thereof and a short distance up either side of the liner 16.

The reinforcing strip 38 is similar in configuration to a breaker strip and, as seen in FIGS. 2 and 3, has flange portions 40 extending downwardly over the front edge of the liner surface 34 and into abutment with the outer case 14. The flange 40 extends upwardly along the side sections 42 of the strip 38 such as to be securely located on the flange surface 18 of the liner 16. The reinforcing strip 38 is preferably formed of injection molded plastic of a type being suitably resistant to impact breakage such as an ABS or polypropylene plastic. The thickness of the material can be greater than the thickness of the liner 16 itself and preferably would be on the order of one hundred-thousandths of an inch thick (0.100).

The configuration of the mating surface of the reinforcing strip 38 is such as to be press or interference fit with the mating liner 16 surface portions such as to insure intimate contact of the reinforcing strip 38 with the surface 34 of the liner 12.

The reinforcing strip 38, according to the present invention, is secured in position by a layer 44 of a double-faced adhesive foam tape which extends along the surface 34 intermediate the undersurface of the reinforcing strip 38. This securely positions the reinforcing strip 38 in position and in addition serves as a shock absorbing cushion which softens the impact force transmitted into the liner 16 and also reduces the shock exerted on the reinforcing strip itself such as to further reduce the incidence of breakage.

It can be seen that the reinforcing strip 38 can be very effectively utilized to repair a damaged liner indicated by the fracture shown at 35 by simply installing the double-faced adhesive foam tape 44 over the surface of the liner 16 and the press fitting of a suitably configured reinforcing strip 38 over the adhesive foam tape 44. This serves to repair the impact fracture 35 and to reinforce the liner to prevent further incidence of damage.

The foam tape 44 can also be preassembled to the reinforcing strip 38 with a protective layer over the exposed side of the foam tape 44. The serviceman can then simply remove the protective layer and install the reinforcing strip 38.

Figure 4:
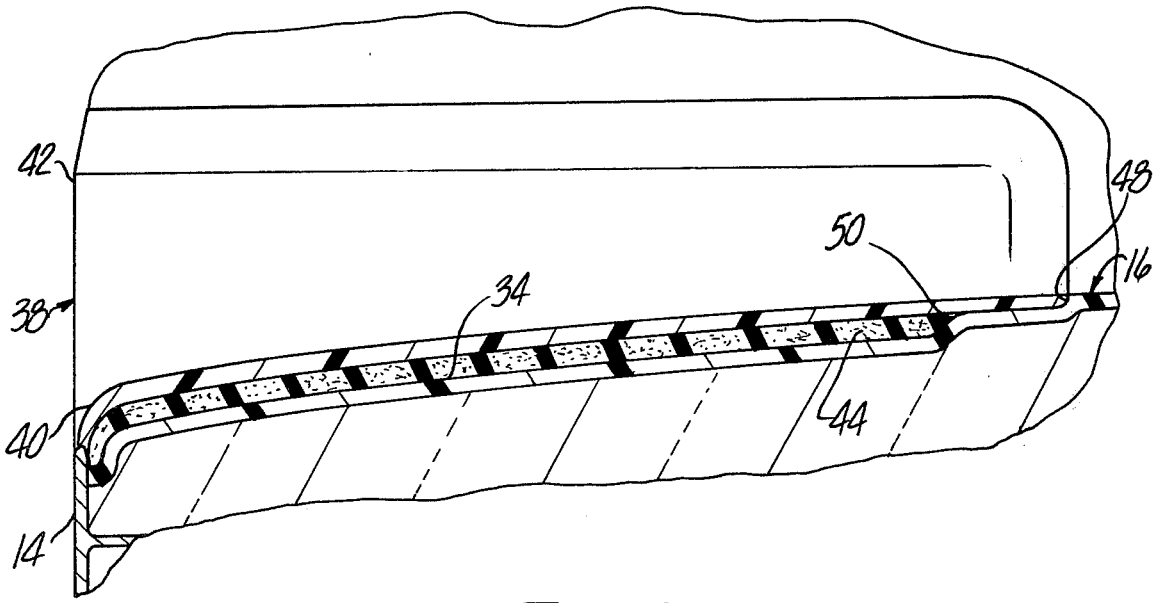
FIG. 4 is a sectional view through an alternate form of reinforcing strip adapted to be applied to an offset liner, designed to accept the reinforcing strip.

In FIG. 4, there is depicted an adaptation of the liner design to accommodate such reinforcing strip. In this case, a first offset 48 is formed into the bottom front area 34 of the liner 16 to accommodate the breaker strip 38 and a second offset 50 formed stepped therefrom as shown to accommodate the adhesive foam tape layer 44 such as to provide a fairing of the reinforcing strip 38 into the remainder of the liner 16 to provide a smoother finished contour.

Accordingly, it can be appreciated that the use of a reinforcing strip 38 can be secured over the vulnerable area of the liner 16 by means of a double-faced adhesive foam tape and allows ready field repair of damaged units and also reinforcement of liners without the need to redesign the liner 16. Such redesign could optionally be carried out in order to provide a neater finished appearance by virtue of the offsets shown in FIG. 4. This repair and/or reinforcement procedure is relatively easily carried out requiring only a short time while the reinforcement strip itself may be manufactured at relatively low cost to thus provide a very advantageous approach in either reinforcement or repair of such refringerator liners.

The embodiments of the invention in which an exclusive property or privilege is claimed are defined as follows:

1. In combination with a refrigerator having a refrigerator cabinet and door, said cabinet including:

a steel outer case;

a refrigerator liner of a plastic material directly joined to said steel outer case;

a liner impact reinforcement comprising a reinforcing strip secured to said refrigerator liner extending across the bottom front surface thereof exposed upon opening movement of said refrigerator door.

2. The refrigerator according to claim 1 further including a resilient layer interposed between said reinforcing strip and said refrigerator liner, whereby said resilient layer acts as an impact cushion to reduce impact damage to said reinforcing strip and refrigerator liner portions.

3. The refrigerator according to claim 2 wherein said resilient layer comprises a double-faced adhesive tape of foam material securing said reinforcing strip to said bottom front surface of said refrigerator liner.

4. The refrigerator according to claim 1 wherein said reinforcing strip includes flange portions extending around and over the outer edges of said refrigerator liner.

5. The refrigerator according to claim 4 wherein said reinforcing strip includes side portions thereof at either end configured to extend into engagement with said refrigerator liner side surface adjacent said bottom surface.

6. The refrigerator according to claim 1 wherein said refrigerator liner is formed with an offset of said bottom front surface to form a recess configured to accommodate said reinforcing strip.

7. The refrigerator according to claim 6 wherein said refrigerator liner is formed with a second offset formed in a second recess area and wherein said impact reinforcement further includes a resilient layer disposed in said second recess and secured to said reinforcing strip and to said bottom front surface of said refrigerator liner.

8. A method of repairing impact damage to refrigerator cabinets of the type having a one-piece plastic liner directly secured to an outer steel case, said impact damage being in the bottom front surface of said refrigerator liner, the method comprising the steps of:

mounting a reinforcing strip configured to mate with the bottom front surface of said refrigerator liner extending across the front of said plastic liner and over the area of impact damage.

9. The method according to claim 8 wherein said step of mounting said reinforcing strip over said impact damage area includes the step of securing a resilient layer to said refrigerator liner bottom front area and to said reinforcing strip, whereby said resilient layer is disposed between said damaged liner and said reinforcing strip.

10. The method according to claim 9 wherein said step of mounting said resilient layer to said damaged bottom front area of said refrigerator liner comprises the step of installing double-faced adhesive tape of foam material over said bottom front surface of said damaged refrigerator liner and subsequently installing said reinforcing strip over said adhesive tape.

* * * * *